US008182080B2

(12) United States Patent
Kawakami et al.

(10) Patent No.: US 8,182,080 B2
(45) Date of Patent: May 22, 2012

(54) IMAGE FORMING METHOD

(75) Inventors: Hiroshi Kawakami, Shizuoka-ken (JP); Naoki Kusunoki, Kanagawa (JP); Yasuhiko Kachi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 374 days.

(21) Appl. No.: 12/630,867

(22) Filed: Dec. 4, 2009

(65) Prior Publication Data

US 2010/0141726 A1 Jun. 10, 2010

(30) Foreign Application Priority Data

Dec. 9, 2008 (JP) ..... 2008-313178

(51) Int. Cl.
*B41J 2/01* (2006.01)

(52) U.S. Cl. ..... 347/102; 347/104

(58) Field of Classification Search ..... 347/16, 347/17, 102, 104
See application file for complete search history.

(56) References Cited

U.S. PATENT DOCUMENTS 7,048,354 B2 * 5/2006 Kawatoko et al. ..... 347/37

FOREIGN PATENT DOCUMENTS

JP 2006-232500 A 9/2006

* cited by examiner

*Primary Examiner* — Daniel Petkovsek
(74) *Attorney, Agent, or Firm* — SOLARIS Intellectual Property Group, PLLC

(57) ABSTRACT

An image forming method includes: moisture-controlling one surface of an inkjet recording medium having an air permeability of 300 seconds or more; feeding the moisture-controlled inkjet recording medium onto a conveyance path in a state where the moisture-controlled inkjet recording medium is curled such that a surface of the moisture-controlled inkjet recording medium that is curved inwards faces the conveyance path for conveying the inkjet recording medium; conveying the fed inkjet recording medium while adhering the inkjet recording medium by suction onto the conveyance path; and forming an image by applying ink by an inkjet method on the inkjet recording medium adhered by suction to the conveyance path.

16 Claims, 9 Drawing Sheets

IMAGE FORMING METHOD

CROSS REFERENCE TO RELATED APPLICATIONS

This application claims priority under 35 USC 119 from Japanese Patent Application No 2008-313178 filed on Dec. 9, 2008, the disclosure of which is incorporated herein by reference.

BACKGROUND OF THE INVENTION

1. Field of the Invention

The present invention relates to an image forming method.

2. Description of the Related Art

Image forming methods for forming images on recording media such as recording paper using image forming apparatuses provided with an inkjet recording head are widely known. In such image forming methods, recording media are conveyed directly below a recording head and images are formed thereon.

In such image forming methods, an uneven distance between the surface of a head and a recording medium may result in deformation of a formed image. In the worst case, a recording head may come into contact with a recording medium, causing damage to the recording head or jamming of the recording medium. For this reason, the rectification of the form of a recording medium has hitherto been performed as disclosed in, for example, Japanese Patent Application Laid-Open (JP-A) No. 2006-232500.

SUMMARY OF THE INVENTION

However, even in the image forming method that uses the image recording apparatus as disclosed in (JP-A) No. 2006-232500, there are cases where failures in the conveyance of a recording medium arise, and in addition, a further increase in printing speed is demanded.

The invention has been made in consideration of these conventional problems.

According to a first aspect of the invention, there is provided an image forming method including:

moisture-controlling one surface of an inkjet recording medium having an air permeability of 300 seconds or more;

feeding the moisture-controlled inkjet recording medium onto a conveyance path in a state where the moisture-controlled inkjet recording medium is curled such that a surface of the moisture-controlled inkjet recording medium that is curved inwards faces the conveyance path for conveying the inkjet recording medium;

conveying the fed inkjet recording medium while adhering the inkjet recording medium by suction onto the conveyance path; and forming an image by applying ink by an inkjet method on the inkjet recording medium adhered by suction to the conveyance path.

According to a second aspect of the invention, there is provided an image forming method including:

moisture-controlling a first surface of a first inkjet recording sheet having the first surface and a second surface and having an air permeability of 300 seconds or more;

feeding the moisture-controlled first inkjet recording sheet onto a conveyance path in a state where the moisture-controlled first inkjet recording sheet is curled such that the first surface of the moisture-controlled first inkjet recording sheet is curved inwards and faces the conveyance path;

conveying the fed first inkjet recording sheet while adhering the first inkjet recording sheet by suction onto the conveyance path; and forming an image by applying ink by an inkjet method on the second surface of the first inkjet recording sheet adhered by suction to the conveyance path.

According to the invention, an image forming method is provided by which occurrence of failures in the conveyance of a recording medium at the time of image formation is suppressed and a high image quality and an increased image printing speed are achieved.

BRIEF DESCRIPTION OF THE DRAWINGS

Exemplary embodiments of the present invention will be described in detail based on the following figures, wherein.

DETAILED DESCRIPTION OF THE INVENTION

Figure 1:
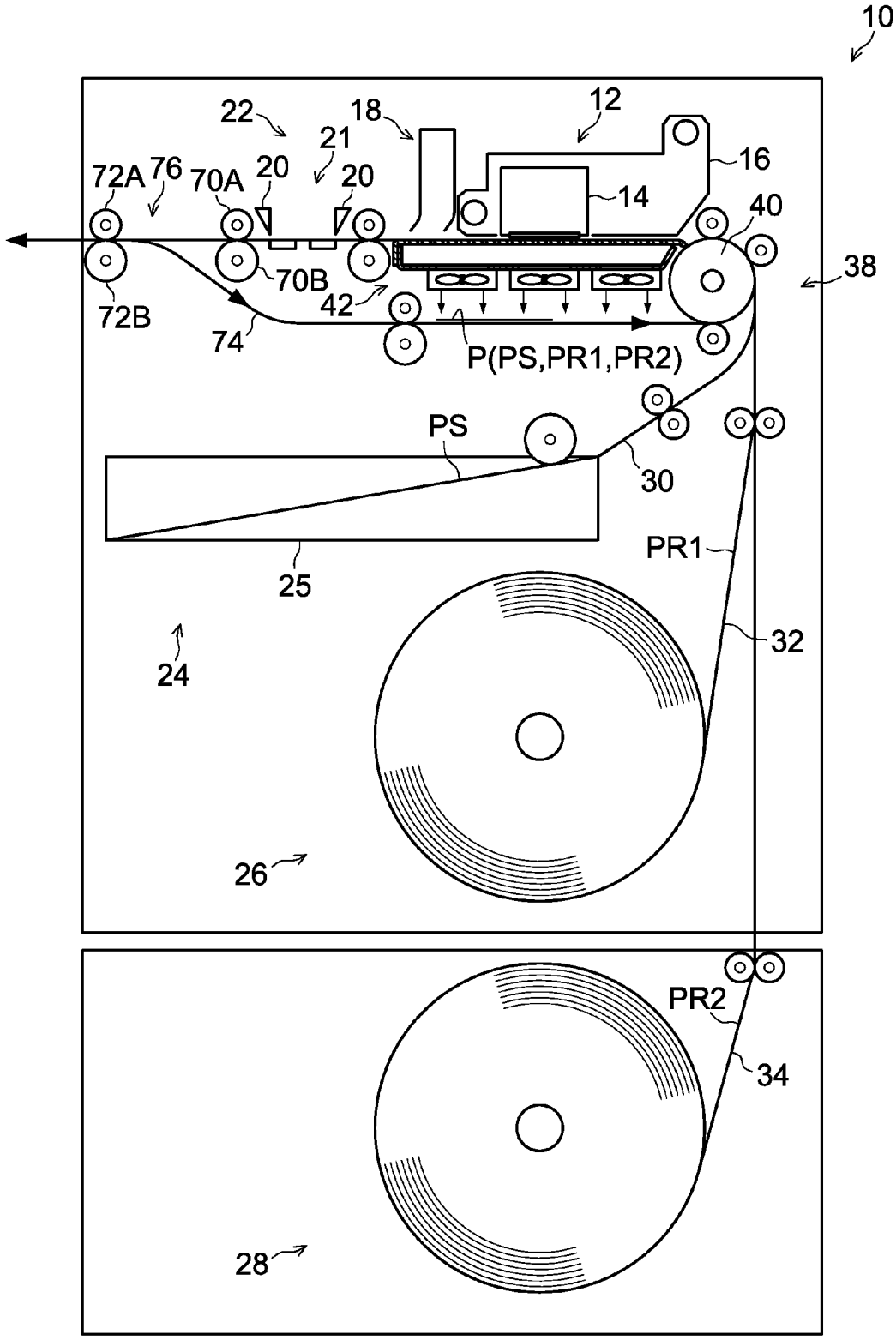
FIG. 1 is a side view showing an example of the configuration of an image forming apparatus according to the invention.

Hereinafter, the invention will be described in detail.

The image forming method of the invention includes: a moisture-control process in which one surface of an inkjet recording medium having an air permeability of 300 seconds or more is moisture-controlled; a feeding process in which the moisture-controlled inkjet recording medium is fed onto a conveyance path for conveying the inkjet recording medium, in a state where the moisture-controlled inkjet recording medium is curled such that a surface of the moisture-controlled inkjet recording medium facing the conveyance path is curved inwards; a suction-conveying process in which the fed inkjet recording medium is conveyed while adhering the inkjet recording medium by suction onto the conveyance path; and an image forming process in which an image is formed by applying ink by an inkjet method on the inkjet recording medium adhered by suction to the conveyance path.

The inkjet recording medium fed to the conveyance path is curled in a specific direction, so that the inkjet recording medium can be more effectively adhered by suction onto the conveyance path, occurrence of failures in conveyance of the recording medium and deterioration of image quality can be suppressed, and the speed of image printing can also be improved.

[Moisture-Control Process]

In the moisture-control process of the invention, one surface of an inkjet recording medium having an air permeability of 300 seconds or more is moisture-controlled. By moisture-controlling one surface of an inkjet recording medium, curling of the inkjet recording medium can be generated in a desired direction. Further, one surface and the other surface of the inkjet recording medium may be moisture-controlled under respectively different conditions such that curling of the inkjet recording medium can be generated in a desired direction.

The inkjet recording medium of the invention is not specifically limited as long as the air permeability thereof is 300 seconds or more. The inkjet recording medium is preferably includes a resin-coated support and an ink receiving layer provided on the support. Further, the inkjet recording medium more preferably includes a resin-coated support and ink receiving layers formed on the respective surfaces of the resin-coated support.

In the invention, the air permeability of the inkjet recording medium is measured by using an Oken type air permeability and smoothness tester (EYO type: manufactured by Asahi Seiko CO., Ltd.) as stipulated in J. TAPPI No. 5B which is incorporated herein by reference. The air permeability of the inkjet recording medium in the invention is 300 seconds or more, is preferably 1,000 seconds or more, and is more preferably 3,000 or more. When the air permeability of the inkjet recording medium is less than 300 seconds, the capability of the inkjet recording material to be adhered by suction onto a conveyance path may be lowered in the suction-conveying process, which will be described later.

Regarding the air permeability of the inkjet recording medium, an inkjet recording medium having a desired air permeability can be obtained, for example, by controlling the air permeability of the support of the inkjet recording medium. Further, the air permeability of the support which constitutes the inkjet recording medium can be controlled by, for example, controlling the material, thickness or density of the support and/or by providing a resin-coated layer on the support.

The inkjet recording medium in the invention, for example, may comprise a support and an ink receiving layer, which are described below.

(Support)

The support in the invention may be any of a transparent support made of a transparent material such as plastic or an opaque support made of an opaque material such as paper. It is preferable to use a transparent support or a highly glossy opaque support in view of utilizing the transparency of the ink receiving layer.

The material used for the transparent support is preferably a transparent material that has resistance to radiant heat when used for an OHP or a back light display. Examples of the material include polyesters such as polyethylene terephthalate (PET), polysulfone, polyphenylene oxide, polyimide, polycarbonate, and polyamide. Among them, polyesters are preferable, and in particular, polyethylene terephthalate is preferable.

The thickness of the transparent support is not specifically restricted, and is preferably from 50 μm to 200 μm, in view of easiness of handling.

In regard to the highly glossy opaque support, the surface, on which an ink receiving layer is to be formed, has a glossiness of preferably 40% or more. The glossiness is a value obtained by the method stipulated in JIS P-8142 (Testing Method for 75° Specular Glossiness of Paper and Paperboard). Specifically, examples thereof include the following supports.

Examples of supports include highly-glossy paper supports such as art paper, coat paper, cast coated paper and baryta coated paper used for supports for silver halide photography; highly-glossy films (the surface of which may have been subjected to a calender treatment) formed by opacifying plastic films such as polyesters (e.g., polyethylene terephthalate (PET)), cellulose esters (e.g., nitrocellulose, cellulose acetate or cellulose acetate butyrate), polysulfone, polyphenylene oxide, polyimide, polycarbonate and polyamide by incorporation of white pigment or the like; and supports having a polyolefin coated layer, which contains or does not contain white pigment, on a surface of any of the various paper supports, transparent supports or highly-glossy films containing white pigment or the like (for example, resin-coated paper).

Foamed polyester films containing a white pigment (for example, foamed PET that contains polyolefin fine particles and having voids formed by stretching) are also preferable.

The thickness of the opaque support is not specifically restricted, and is preferably from 50 μm to 300 μm, in view of easiness of handling.

Moreover, in order to improve wetting characteristics and adhesiveness, the surface of the support may be subjected to a corona discharge treatment, glow discharge treatment, flame treatment, ultraviolet irradiation treatment or the like, and the treated support may be used.

The base paper sheet used for the resin coat paper will be described in detail below.

The base paper is produced using a wood pulp as a major raw material and, optionally, a synthetic pulp such as polypropylene pulp and/or synthetic fibers such as nylon or polyester fibers, as necessary. While any one of LBKP, LBSP, NBKP, NBSP, LDP, NDP, LUKP and NUKP may be used as the wood pulp, it is preferable to use a greater amount of LBKP, NBSP, LBSP, NDP and LDP, which contain a high proportion of short fibers, than other wood pulps.

However, the proportion of LBSP and/or LDP is preferably from 10% by mass to 70% by mass.

The pulp is preferably a chemical pulp containing less impurities (such as sulfate pulp or sulfite pulp). A pulp of which brightness has been improved by a bleaching treatment is also useful.

One or more of the following agents may be added to the base paper sheet as necessary: sizing agents such as higher fatty acids and alkyl ketenedimers; white pigments such as calcium carbonate, talc and titanium oxide; paper strength enhancers such as starch, polyacrylamide and polyvinyl alcohol; fluorescent brightening agents, humectants such as polyethylene glycols; dispersants; softening agents such as quaternary ammonium.

The freeness stipulated in the Canadian Standard Freeness (CSF) of the pulp used for papermaking is preferably from 200 ml to 500 ml. Regarding the fiber length after beating, the sum of the percentage by mass of 24-mesh filtration residue and the percentage by mass of the 42-mesh filtration residue as stipulated in JIS P-8207 is preferably from 30% to 70%. Further, the percentage by mass of the 4-mesh filtration residue is preferably 20% by mass or less.

The basis weight of the base paper is preferably from 30 $g/m^2$ to 250 $g/m^2$, and is particularly preferably from 50 $g/m^2$ to 200 $g/m^2$. The thickness of the base paper is preferably from 40 μm to 250 μm. The base paper may be subjected to a calender treatment in the process of papermaking or after papermaking to impart high degree of smoothness to the base paper. The density of the base paper is generally from 0.7 $g/m^3$ to 1.2 $g/m^3$ (JIS P-8118). Further, the stiffness of the base paper is preferably from 20 g to 200 g under the conditions stipulated in JIS P-8143.

The surface of the base paper may be coated with a surface sizing agent, and the surface sizing agent may be selected from the above-described examples of sizing agents that can be incorporated into the interior of the base paper. The pH value of the base paper is preferably from 5 to 9 when measured by the hot water extraction method stipulated in JIS P-8133.

The polyethylene that covers the front surface and the rear surface of the base paper may mainly include low density polyethylene (LDPE) and/or high density polyethylene (HDPE), and may further include another polyethylene such as LLDPE, polypropylene or the like as a minor component.

In particular, the polyethylene layer at the side at which an ink receiving layer is to be formed has preferably an improved opacity, whiteness and color hue by adding rutile or anatase type titanium oxide, a fluorescent brightening agent and/or ultramarine blue into polyethylene, which is a widely-used technique for photographic printing paper. The content of titanium oxide is preferably from about 3% by mass to about 20% by mass, and is more preferably from about 4% by mass to about 13% by mass, with respect to the total amount of polyethylene. The thickness of the polyethylene layer is not specifically limited. The polyethylene layer at the front side and the polyethylene layer at the back side each preferably has a thickness of from 10 μm to 50 μm. Further, an undercoat layer that improves adhesion to the ink receiving layer may be provided on the polyethylene layer. The material of the undercoat layer is preferably aqueous polyester, gelatin or PVA. Moreover, the thickness of the undercoat layer is preferably from 0.01 μm to 5 μm.

The polyethylene-coated paper (resin-coated paper) may be used as glossy paper or as paper that is provided with a matt or silky surface similar to common photographic printing paper by being subjected to a so-called embossing process at the time when the base paper is coated with polyethylene by a melt-extrusion process.

A backcoat layer may also be formed on the support, and examples of components to be added to the backcoat layer include white pigments, aqueous binders, and other components.

Examples of white pigments that can be contained in the backcoat layer include white inorganic pigments such as light calcium carbonate, heavy calcium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, colloidal alumina, pseudo boehmite, aluminum hydroxide, alumina, lithopone, zeolite, hydrated halloysite, magnesium carbonate and magnesium hydroxide; and organic pigments such as styrene-based plastic pigments, acrylic plastic pigments, polyethylene, microcapsules, urea resins and melamine resins.

Examples of aqueous binders that can be used in the backcoat layer include water-soluble polymers such as styrene/maleate salt copolymer, styrene/acrylate salt copolymer, polyvinyl alcohol, silanol-modified polyvinyl alcohol, starch, cationated starch, casein, gelatin, carboxymethyl cellulose, hydroxyethyl cellulose, and polyvinyl pyrrolidone; and water-dispersible polymers such as styrene butadiene latex and acrylic emulsion.

Examples of other components contained in the backcoat layer include defoaming agents, foam inhibitors, dyes, fluorescent brightening agents, antiseptics and water-proofing agents.

(Ink Receiving Layer)

The ink receiving layer in the invention contains preferably inorganic fine particles and a water-soluble resin, and optionally contains other components such as a crosslinking agent, a nitrogen-containing organic cationic polymer, a sulfur-containing compound, a water-soluble polyvalent metal salt or a surfactant.

(Inorganic Particles)

The ink receiving layer in the invention contains preferably at least one kind of inorganic particles. The inorganic fine particles play a role in forming a porous structure when the ink receiving layer is formed, and in enhancing ink absorptivity.

In particular, when the solid content of the inorganic fine particles in the ink receiving layer is 50% by mass or more (more preferably more than 60% by mass), the ink receiving layer can form a better porous structure, so that an inkjet recording medium with sufficient ink absorptivity can be obtained, which is preferable in view of ink absorptivity. Here, the solid content of the inorganic fine particles in the ink receiving layer refers to the content calculated on the basis of the components other than water in the composition that constitutes the ink receiving layer.

As the inorganic fine particles in the invention, for example, the inorganic fine particles described in Paragraph Nos. [0034] to [0042] in JP-A No. 2008-246988 may be exemplified, and preferable embodiments thereof are also the same as those described in JP-A No. 2008-246988.

(Water-Soluble Resin)

The ink receiving layer in the invention contains preferably at least one water-soluble resin. Examples of water-soluble resins in the invention include the water-soluble resins described in Paragraph Nos. [0043] to [0048] of JP-A No. 2008-246988, and preferable embodiments thereof are also the same as those described in JP-A No. 2008-246988.

In the invention, the kind of the water-soluble resin to be combined with the inorganic fine particles (particularly, silica fine particles) is important from the viewpoint of maintaining transparency. When a vapor-phase-process silica is used, the water-soluble resin is preferably a polyvinyl alcohol resin, a polyvinyl alcohol resin having a saponification degree of from 70% to 100% is more preferable, and a polyvinyl alcohol resin having a saponification degree of from 80% to 99.5% is particularly preferable.

(Content Ratio of Inorganic Fine Particles and Water-Soluble Resin)

It is possible to further improve the film structure and film strength of the ink receiving layer by optimizing the mass content ratio (PB ratio (x:y)) of inorganic fine particles (x) to water-soluble resin (y).

The mass content ratio (PB ratio (x:y)) of the ink receiving layer is preferably from 1.5:1 to 10:1 from the viewpoints of preventing decrease in film strength or occurrence of cracks during drying that may result from an excessively large PB ratio, and of preventing decrease in ink absorptivity due to decreased porosity caused by increased tendency for voids to be clogged by resin resulting from an excessively small PB ratio.

In particular, it is preferable that the x/y ratio of the upper half of the ink receiving layer is equal to or higher than the x/y ratio of the lower half of the ink receiving layer (i.e., the PB ratio of the upper half and the PB ratio of the lower half are the same, or the lower half of the ink receiving layer is more binder-rich). It is particularly preferable that the PB ratios of the upper half and the lower half are equal to each other.

Since a recording medium may be subjected to stress when the recording medium passes through a conveyance system of an inkjet printer, the ink receiving layer preferably has sufficient film strength. Further, when a recording medium is cut in a sheet-shape, the ink receiving layer preferably has sufficient film strength in view of preventing, for example, cracks and/or exfoliation of the ink receiving layer. In consideration of these cases, the mass ratio (x:y) is more preferably 5:1 or less, and, from the viewpoint of maintaining rapid ink absorptivity when an inkjet printer is used, the mass ratio (x:y) is more preferably 2:1 or more.

For example, when a coating liquid obtained by thoroughly dispersing vapor-phase-process silica fine particles having a number average primary particle diameter of 20 nm or less and a water-soluble resin at a mass ratio (x;y) of 2:1 to 5:1 in an aqueous solution is coated on a support and the resultant coated layer is dried, a three-dimensional network structure with network chains of secondary particles of silica fine particles is formed; thus, a light-transmissive porous film can be easily formed which has an average pore diameter of from 30 nm or less, a porosity of from 50% to 80%, a specific pore volume of 0.5 ml/g or more and a specific surface area of 100 $m^2/g$ or more.

(Crosslinking Agent)

The ink receiving layer in the invention contains preferably at least one crosslinking agent from the viewpoint of crosslinking the water-soluble resin.

It is preferable that the ink receiving layer in the invention contains the inorganic fine particles and the water-soluble resin in combination, and that the ink receiving layer is a porous layer cured by a crosslinking reaction between the crosslinking agent and the water-soluble resin.

Examples of the crosslinking agent include crosslinking agents described in Paragraph Nos. [0127] to [0129] of JP-A No. 2008-246988, and preferable embodiments thereof are also the same as described in JP-A No. 2008-246988.

(Nitrogen-Containing Organic Cationic Polymer)

The ink receiving layer in the invention contains preferably at least one nitrogen-containing organic cationic polymer from the viewpoints of suppressing bleed of recorded images and dispersing silica.

The nitrogen-containing organic cationic polymer in the invention is not specifically limited, and is preferably a polymer containing a primary, secondary or tertiary amino group or a quaternary ammonium salt group.

It is preferable that the nitrogen-containing organic cationic polymer is a homopolymer of a monomer containing a primary, secondary or tertiary amino group or a salt thereof or a quaternary ammonium salt group (nitrogen-containing organic cationic monomer), or a copolymer or polycondensate of the nitrogen-containing organic cationic monomer and one or more other monomers. Further, the nitrogen-containing organic cationic polymer may be used in any form selected from a water-soluble polymer or water-dispersible latex particles.

Specific examples of the nitrogen-containing organic cationic polymers in the invention include the nitrogen-containing organic cationic polymers described in Paragraph Nos. [0024] to [0031] of JP-A No. 2008-246988, and preferable embodiments thereof are also the same as those described in JP-A No. 2008-246988.

(Sulfur-Containing Compound)

The ink receiving layer in the invention contains preferably at least one sulfur-containing compound from the viewpoint of increasing the ozone-resistance.

The sulfur-containing compound is preferably at least one selected from a thioether-containing compound, a thiourea-containing compound, a disulfide-containing compound, a sulfinic acid-containing compound, a thiocyanic acid-containing compound, a sulfur-containing heterocyclic compound or a sulfoxide-containing compound.

Specific examples of the sulfur-containing compound in the invention include the sulfur-containing compounds as described in Paragraph Nos. [0054] to [0118] of JP-A No. 2008-246988, and preferable embodiments thereof are also the same as those of JP-A No. 2008-246988.

(Water-Soluble Polyvalent Metal Salt)

The ink receiving layer in the invention contains preferably at least one water-soluble polyvalent metal salt. The water-soluble polyvalent metal salt can enhance the weather resistance of formed images by acting as a mordant, for example.

Specific examples of the water-soluble polyvalent metal salts in the invention include magnesium salts as described in Paragraph Nos. [0122] to [0124] of JP-A No. 2008-246988, and the water-soluble polyvalent metal salts as described in Paragraph Nos. [0131] to [0137] of JP-A No. 2008-246988, and preferable embodiments thereof are also the same as those of JP-A No. 2008-246988

(Other Components)

The ink receiving layer in the invention may contain one or more other components, examples of which include various surfactants and mordants other than the above-described nitrogen-containing organic cationic polymers, magnesium salts and water-soluble polyvalent metal salts.

The other components may be appropriately selected from, for example, the components described in Paragraph Nos. [0088] to [0117] of JP-A No. 2005-14593 and the components described in Paragraph Nos. [0138] to [0155] of JP-A No. 2006-321176.

The thickness of the ink receiving layer in the invention is determined preferably in relation to the porosity of the layer, from the viewpoint of attaining the absorption capacity that allows absorption of all the liquid droplets. For example, when the ink quantity is 8 $nl/mm^2$ and the porosity is 60%, the ink receiving layer should have a thickness of 15 μm or more.

In consideration of the above, the thickness of the ink receiving layer is preferably from 10 μm to 50 μm, and is more preferably from 20 μm to 40 μm.

Further, the pore diameter of the ink receiving layer is preferably from 0.005 μm to 0.030 μm, and more preferably from 0.01 μm to 0.025 μm, in terms of median diameter.

The porosity and the pore median diameter can be measured using a mercury porosimeter (PORESIZER 9320-PC2 (trade name) manufactured by Shimadzu Corporation).

The inkjet recording medium of the invention can be manufactured by usual methods. For example, the manufacturing method of the inkjet recording medium described in Paragraph Nos. [0160] to [0203] of JP-A No. 2008-246988 may be applied to the manufacturing of the inkjet recording medium of the invention.

In the humidity conditioning process of the invention, the moisture content in one surface of the inkjet recording medium (this surface is hereinafter referred to as "moisture-control surface" in some cases) is controlled. The method of controlling the moisture content in the invention is not specifically restricted, and a method of reducing the relative humidity of one surface of the inkjet recording medium is preferred from the viewpoint of more effectively forming curl in a desired orientation. Decreased relative humidity of the moisture-control surface of the inkjet recording medium results in contraction of the moisture-control surface (for example, ink receiving layer), thereby causing curling such that the moisture-control surface is curved inwards.

The method of decreasing the moisture content of one surface of the inkjet recording medium of the invention is not specifically restricted, and may be, for example, a method of blowing air onto the moisture-control surface. Air to be blown to the moisture-control surface in the invention is not specifically restricted, and is preferably the air used in the below-mentioned drying process and/or the air used in the below-mentioned negative pressure suction process from the viewpoint of downsizing the inkjet recording apparatus used in the invention, and is more preferably both the air used in the drying process and the air used in the negative pressure suction process.

The air to be blown in the moisture-control process has a relative humidity of, for example, from 1% RH to 70% RH, and preferably from 40% RH to 70% RH, from the viewpoint of curl formability. Further, the temperature of the blown air may be from 20° C. to 80° C., and is preferably from 20° C. to 30° C. The wind speed of the air is, for example, from 0.1 m/s to 10 m/s, and is preferably from 1 m/s to 5 m/s. Furthermore, the method of blowing air may be selected from commonly-used air blowing methods without limitation.

In the medium feeding process, the inkjet recording medium in a curled state in which the moisture-control surface forms a concave curve is fed to a conveyance path with the moisture-control surface of the inkjet recording medium facing the conveyance path. As a result, the inkjet recording medium is in a state in which the inkjet recording medium is curled such that the inkjet recording medium surface facing the conveyance path forms a concave curve.

The feeding method in this process may be selected from usual methods used without particular limitations, and may be, for example, a method in which a recording medium in a rolled shape or a recording medium in a sheet-shape is fed to a recording section via a paper feed roller and a sub-scanning roller.

In the suction-conveying process, the inkjet recording medium, which has been fed in a curled state with its concavely curved surface facing the conveyance path, is conveyed while being adhered by suction onto the conveyance path. Feeding the inkjet recording medium in a curled state with its concavely curved surface facing the conveyance path improves the efficiency of adhesion, by suction, of the inkjet recording medium onto the conveyance path. The method of suctioning the inkjet recording medium to the conveyance path in the invention is preferably a negative pressure suctioning method from the viewpoint of image forming property and suctioning efficiency.

The negative pressure suctioning method may be selected from usual methods without particular limitations, and may be, for example, a method of providing a suction fan to the conveyance path or a method of negative pressure suctioning the conveyance path.

In the image forming process, an image is formed on the inkjet recording medium, which is adhered by suction to the conveyance path, by applying ink by an inkjet method. Since ink is applied to the inkjet recording medium in a state in which the inkjet recording medium is adhered by suction onto the conveyance path, the contact of the recording medium with a head and/or damage to images can be prevented, so that an image can be formed with a high quality at high speed.

The inkjet method in the invention is not specifically restricted, and a known method may be used. Examples thereof include a charge control method in which ink is ejected by utilizing an electrostatic attractive force, a drop-on-demand method (pressure pulse method) utilizing the vibration pressure of a piezoelectric element, an acoustic inkjet method in which ink is irradiated with an acoustic beam converted from an electric signal so as to be ejected using a radiation pressure, and a thermal inkjet method using a pressure generated by bubbles formed by heating ink. The inkjet methods include a method in which a number of droplets of an ink having a low concentration, so-called photo ink, that have a small volume are ejected, a method in which plural inks having substantially the same color hue and different concentrations are used for improving image quality, and a method using a colorless transparent ink.

The amount of ink to be applied in the image forming process in the invention is not specifically restricted, and, for example, is preferably less than 16 ml/$m^2$ from the viewpoint of curl forming property.

Hereinafter, an image forming apparatus which may be used for the image forming method of the invention is described with reference to the drawings. In addition, members having substantially the same action or function are designated by the same reference numeral throughout the drawings, and overlapping explanations thereof may be omitted.

Figure 2:
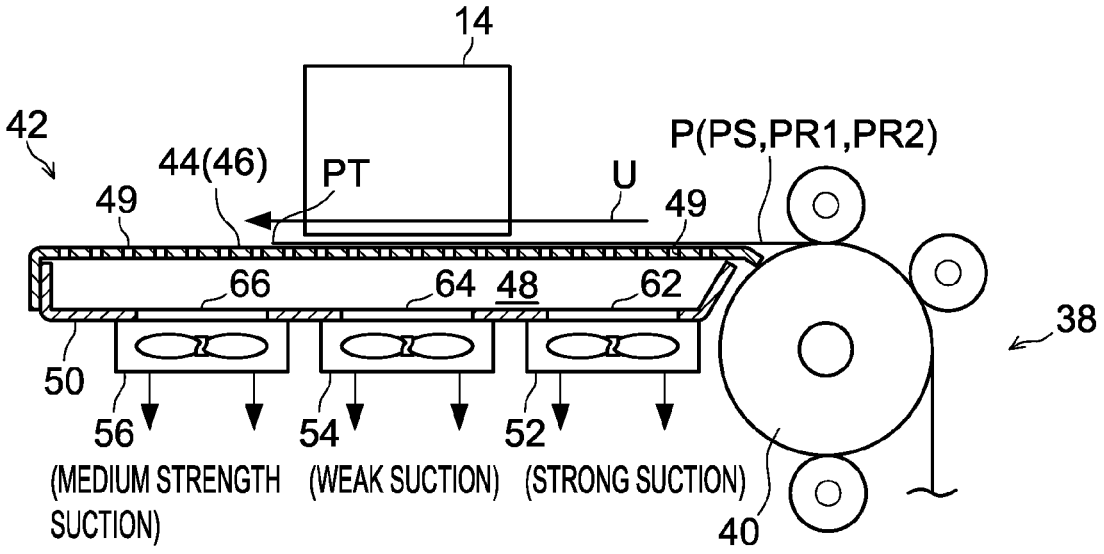
FIG. 2 is a cross-sectional side view showing that recording paper is suction-conveyed in an image forming apparatus according to the invention.

As shown in FIGS. 1 and 2, an image forming apparatus 10 of the invention is provided with an image forming section 12 that forms an image on an inkjet recording medium (hereinafter, may be referred to as "recording paper"). The image forming section 12 has an inkjet recording head 14 that ejects ink droplets towards recording paper, and a carriage 16 that holds the inkjet recording head 14. Although the image forming apparatus 10 is described to be a color image forming apparatus that forms an image using four colors of Y (yellow), M (magenta), C (cyan) and K (black), the configuration described herein is also applicable to a monochromatic image forming apparatus.

The image forming apparatus 10 further includes a dryer 18 that solidifies ink droplets by blowing drying air to a recording paper surface on which the image has been formed by an inkjet recording head 14, a cutter 20 that cuts the recording paper, and a main conveyance section 22 that conveys the recording paper to the inkjet recording head 14, the dryer 18 and the cutter 20, sequentially. The dryer 18 is provided with a fan that blows air and a heater disposed at the upstream side or downstream side of the fan. Although the cutter 20 is shown to have two blades in FIG. 1, the number of the blades may alternatively be one.

The image forming apparatus 10 further includes a sheet feed unit 24 that feeds sheet-shaped recording paper, and a first roll paper feed unit 26 and a second roll paper feed unit 28 each of which feeds banner recording paper. The sheet feed unit 24 has a sheet feed cassette 25 that accommodates recording paper of which upper surface side is open to the atmosphere. Moreover, any recording sheets fed from the sheet feed unit 24, the first roll paper feed unit 26 and the second roll paper feed unit 28 are rotated by a sub-scanning roller 40, which will be described later, and are fed to the main conveyance section 22.

(Conveyance Mechanism)

Hereafter, the conveyance mechanism of the image forming apparatus 10, including the main conveyance section 22, is described in detail.

The image forming apparatus 10 has a sheet conveyance section 30 that conveys the sheet-shaped recording paper PS fed from the sheet feed unit 24, a first roll paper conveyance section 32 that conveys banner recording paper PR1 unrolled from the first roll paper feed unit 26, and a second roll paper conveyance section 34 that conveys banner recording paper PR2 unrolled from the second roll paper feed unit 28 (hereinafter, the term "recording paper P" is used as a general term for the recording paper PS, PR1 and PR2 for convenience of description).

Further, the image forming apparatus 10 has a decurl conveyance section 38 that feeds the recording papers fed from the sheet feed unit 24, the first roll paper feed unit 26 and the second roll paper feed unit 28 to the main conveyance section 22, and also reduces curl of a recording paper fed from a switchback conveyance path 74, which will be described later. In addition, the decurl conveyance section 38 reduces the curl of the recording paper PS fed from the sheet feed unit 24 to some extent.

The decurl conveyance section 38 has a sub-scanning roller 40 that feeds, to the main conveyance section 22, any of recording papers P fed from the sheet conveyance section 30, the first roll paper conveyance section 32 and the second roll paper conveyance section 34.

When the sub-scanning roller 40 conveys recording paper PS fed from the sheet feed unit 24, a side of the recording paper PS that was the upper side when the recording paper PS was accommodated in the sheet feed unit 24 is the surface to be wound around the roller 40 (namely, the surface that comes into contact with the outer circumferential surface of the roller), such that a paper surface on which an image is to be formed is the outer peripheral surface of the recording paper PS wound around the roller 40. Further, when the sub-scanning roller 40 conveys any of the recording paper PR1 unrolled from the first roll paper feed unit 26 or the recording paper PR2 unrolled from the second roll paper feed unit 28, a paper surface wound around the roller 40 is the surface that was the inner circumferential surface when the recording paper was rolled in the roll paper feed unit 26 or 28.

The main conveyance section 22 is provided with a suction conveyance section 42. The suction conveyance section 42 conveys the recording paper P, which is fed from the sub-scanning roller 40, to a region at which an image is formed by the image forming section 12 (namely, directly below the inkjet recording head 14) while the recording paper is adhered by suction, and further conveys the recording paper P, which is adhered by suction, to a region that is exposed to the drying air blown from the dryer 18. Furthermore, the main conveyance section 22 has a cutter conveyance section 21 that conveys the recording paper P, which is fed from the suction conveyance section 42, to a region at which the recording paper p is cut with a cutter 20.

The suction conveyance section 42 is provided with a conveyance path-forming member 46 of which upper surface forms the conveyance path 44 and, under the conveyance path 44, an air chamber-forming member 50 having a depressed shape. The air chamber-forming member 50 and the conveyance path-forming member 46 together form an air chamber 48 therebetween. The conveyance path-forming member 46 has a number of openings 49 that allows the air chamber 48 to communicate with the upper side of the conveyance path 44.

Further, the suction conveyance section 42 has three suction fans 52, 54 and 56 that are arranged under the air chamber-forming member 50 in this order along the conveyance direction U of the suction conveyance section 42. Openings 62, 64 and 66 are formed at the bottom of the air chamber-forming member 50 such that the suction fans 52, 54 and 56 each communicate with the air chamber 48. The recording paper P is conveyed while being adhered by suction onto the conveyance path 44 due to negative pressure suction by the suction fans 52, 54 and 56.

In the image forming apparatus of the invention, the suction force generated by the suction fan 52 disposed at the inlet side of the conveyance path 44, which is closest to the sub-scanning roller 40, is strong; the suction force generated by the suction fan 54 that performs suction directly below the inkjet recording head 14 is weak; and the suction force generated by the suction fan 56 at the outlet side of the conveyance path 44, which is closest to the dryer 18, is medium. With such a suction force distribution formed along the conveyance direction U of the conveyance path 44, an adhesion force distribution is formed along the conveyance direction U of the conveyance path 44.

Figure 4:
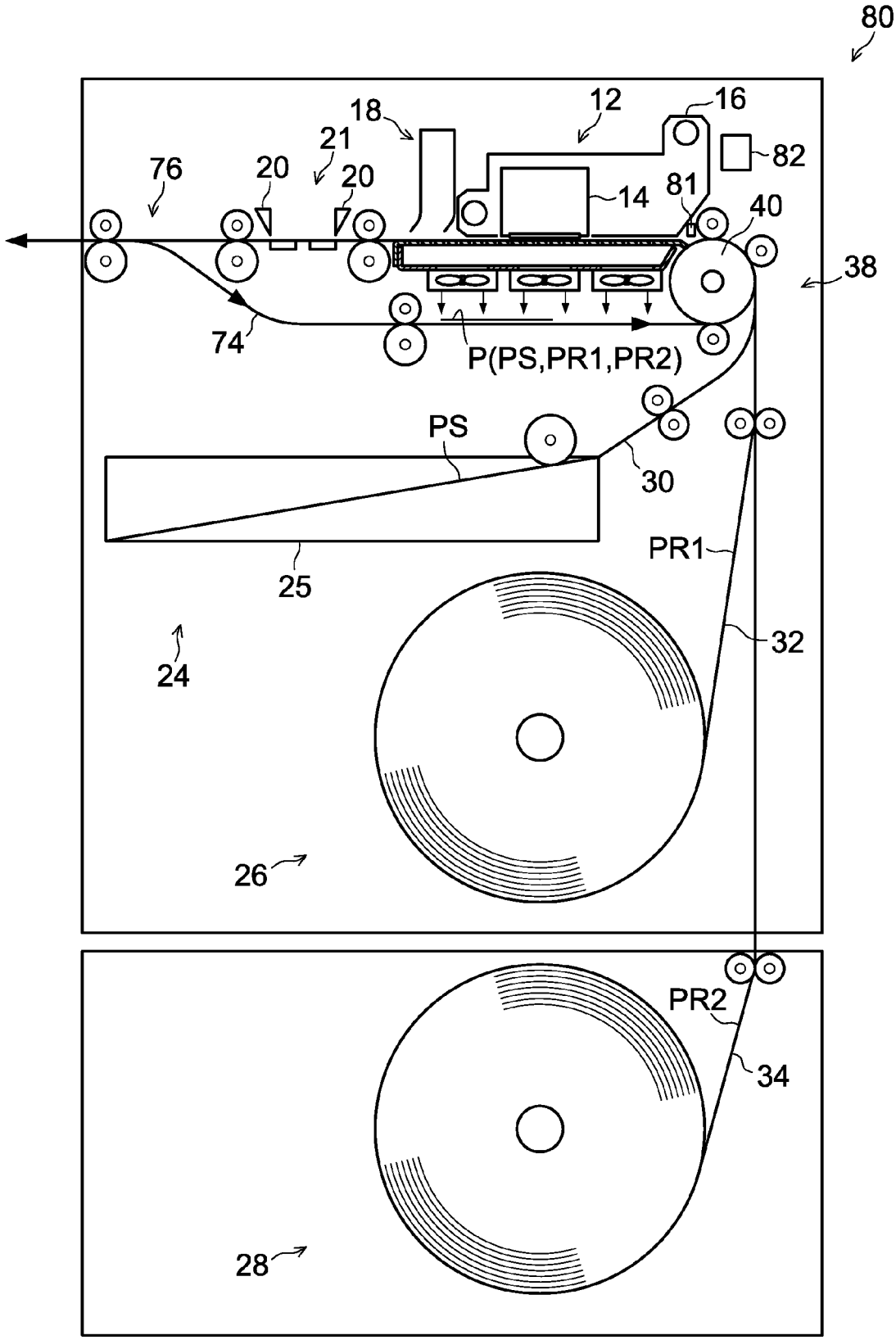
FIG. 4 is a side view showing the configuration of an image forming apparatus according to the invention.

In the invention, a sensor 81 that detects the position of the leading end of the recording paper P in the conveyance direction on the conveyance path 44, and a control unit 82 that controls the suction force of each of the suction fans 52, 54 and 56 based on the signals received from the sensor 81 may be provided, as shown in FIG. 4. With this configuration, the distribution of the suction force along the conveyance direction U can be controlled by the control unit 82, and the distribution of the attraction force on the conveyance path 44 along the conveyance direction U is controlled.

In this way, the distribution of the adhesion force can be adjusted in accordance with the position of the conveyed recording paper P, thereby producing more remarkable effect in conveying the recording paper P while avoiding separation of the leading end of the recording paper P from the recording paper P.

Figure 5A:
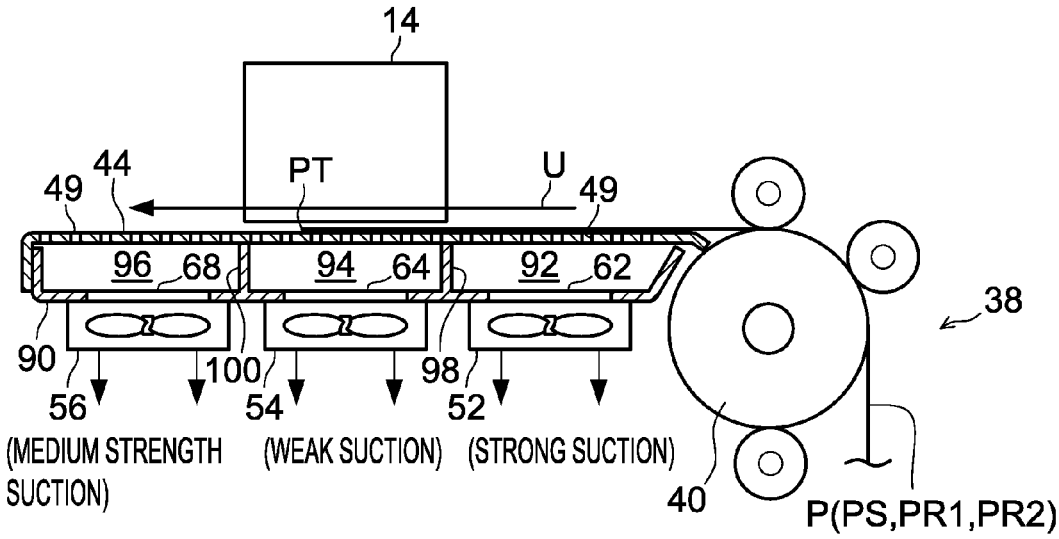
FIG. 5A is a cross-sectional side view showing that recording paper is suction-conveyed in an image forming apparatus according to the invention.
Figure 5B:
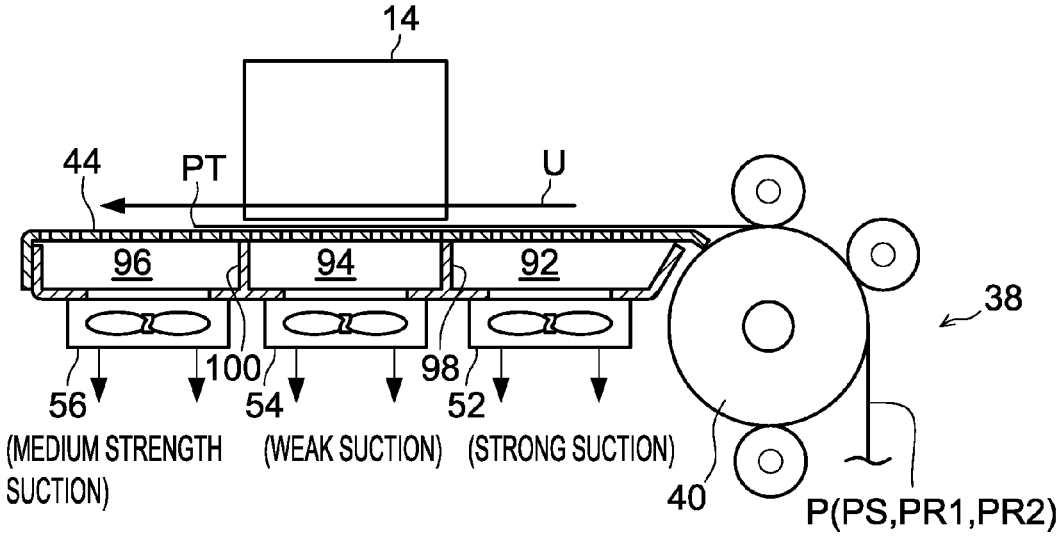
FIG. 5B is a cross-sectional side view showing that recording paper is suction-conveyed in an image forming apparatus according to the invention.

In the image forming apparatus of the invention, an air chamber-forming member 90 may be provided in place of the air chamber-forming member 50. The air chamber-forming member 90 is provided with partition wall portions 98 and 100 such that three air chambers 92, 94 and 96 are formed between the air chamber-forming member 90 and the conveyance-path forming member 46 from the upstream side to the downstream side of the conveyance direction U, as shown in FIGS. 5A and 5B. The suction fans 52, 54 and 56 are provided so as to reduce the pressures of the air chambers 92, 94 and 96 to negative pressures by suction. Accordingly, the suction fan 52 performs strong suction (suction with high flow rate), the suction fan 54 performs weak suction (suction with low flow rate) and the suction fan 56 performs medium strength suction (suction with medium flow rate).

Figure 6:
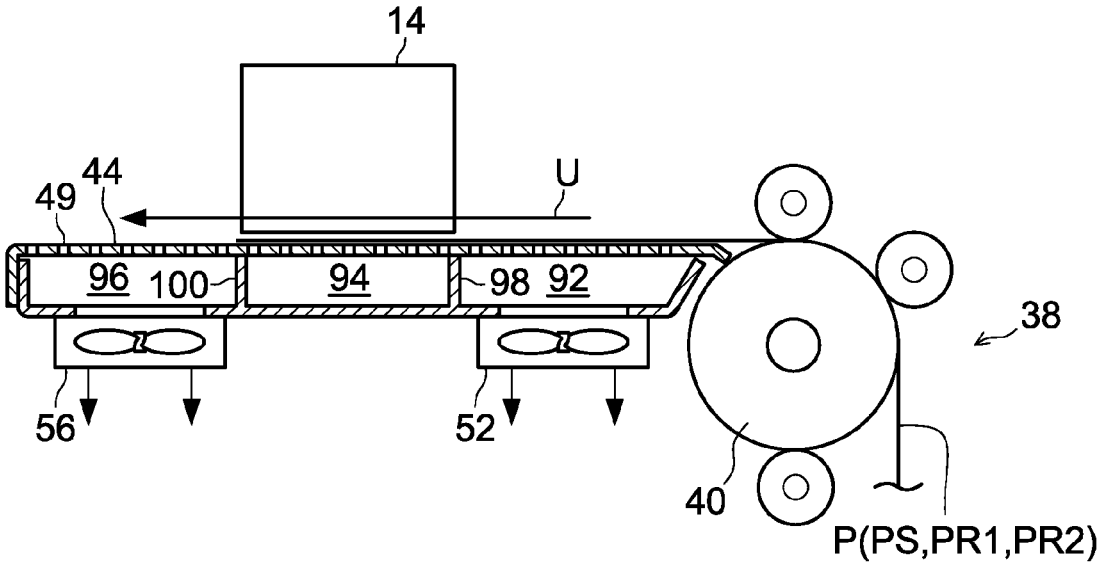
FIG. 6 is a cross-sectional side view showing an example of a suction-conveyance section in an image forming apparatus according to the invention.

As shown in FIG. 6, a configuration may be used in which the air in the air chamber 94 directly below the inkjet recording head 14 is not suctioned. This configuration enables negative pressure suction to be performed while suppressing air turbulence directly below the inkjet recording head 14.

Figure 7A:
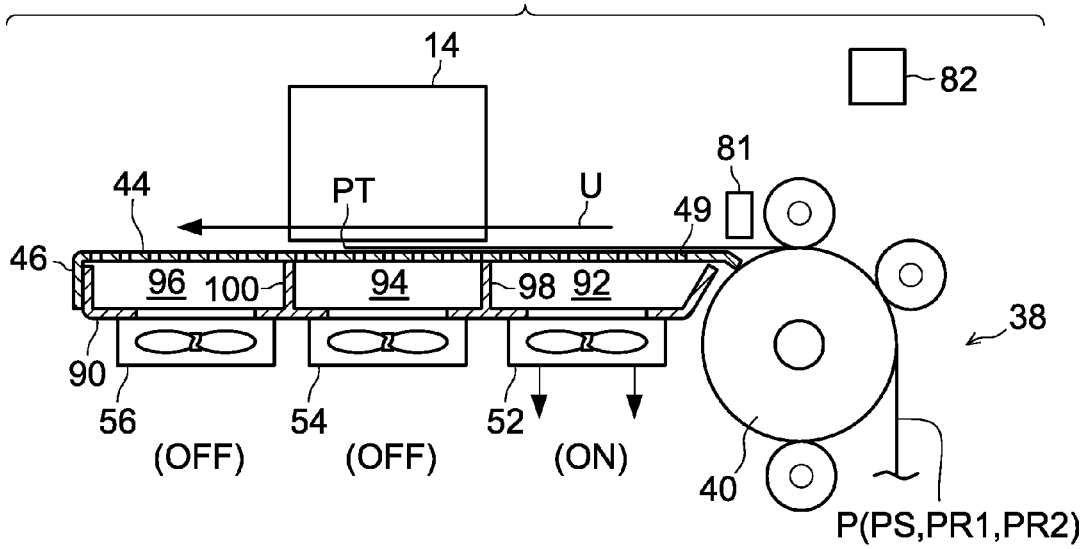
FIG. 7A is a cross-sectional side view showing the state before the leading end of recording paper passes directly below an inkjet recording head in the image forming apparatus according to the invention.
Figure 7B:
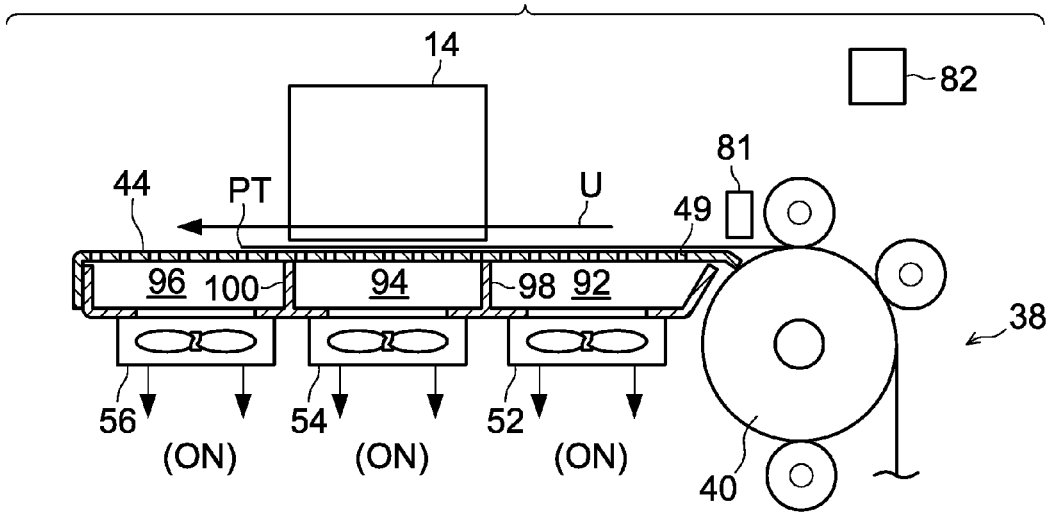
FIG. 7B is a cross-sectional side view showing the state after the leading end of recording paper has passed directly below the inkjet recording head in the image forming apparatus according to the invention.

As shown in FIGS. 7A and 7B, a sensor 81 and a control unit 82 may be provided to control the suction force generated by the suction fans 52, 54 and 56. This configuration allows such a control that the position of the leading end PT of the recording paper P is detected by the sensor 81, and the negative pressure suction is not performed until the leading end PT of the recording paper P passes directly under (immediately below) the inkjet recording head 14 (i.e., the negative pressure suction by the suction fans 54 and 56 is not performed until the leading end PT of the recording paper P passes directly below the inkjet recording head 14). Accordingly, the negative pressure suction can be performed while suppressing air turbulence directly below the inkjet recording head 14, as a result of which an improved image can be formed.

The image forming apparatus 10 has, under the suction conveyance section 42 and the cutter conveyance section 21, a switchback conveyance path 74 in parallel with the suction conveyance section 42 and the cutter conveyance section 21. The switchback conveyance path 74 is branched from the branch section 76. The branch section 76 is disposed between a conveyance roller pair consisting of conveyance rollers 70A and 70B, which are disposed at immediately downstream the cutter conveyance section 21, and a conveyance roller pair consisting of conveyance rollers 72A and 72B, which are disposed at the downstream side of the conveyance rollers 70A and 70B. The switchback conveyance path 74 reaches the decurl conveyance section 38. The air discharged from the suction fans 52, 54 and 56 is blown to the upper surface of the recording paper P that is being conveyed on the switchback conveyance path 74.

Figure 8A:
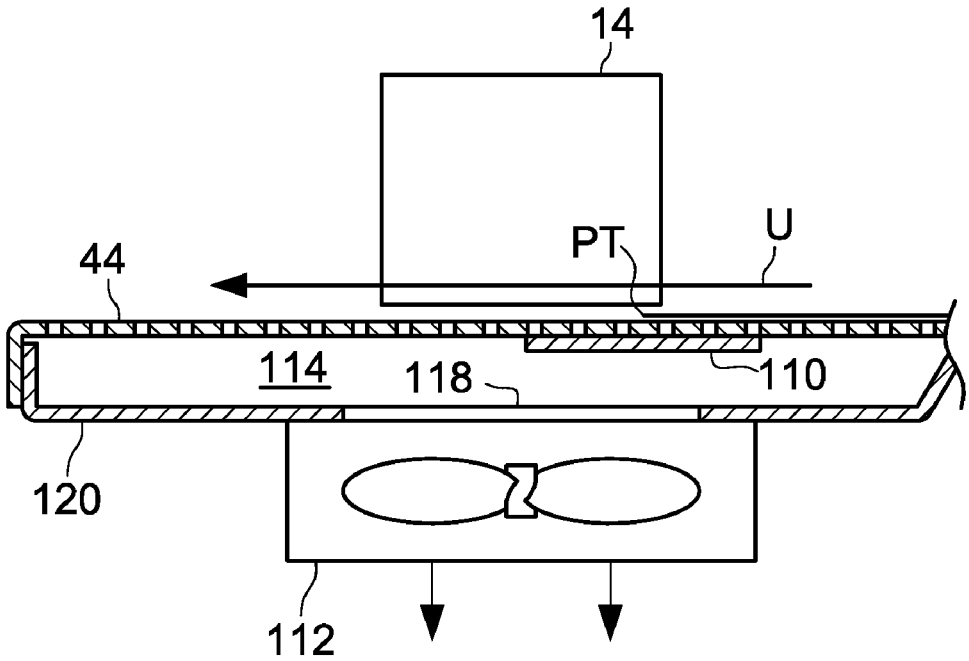
FIG. 8A is a cross-sectional side view showing the state where, directly below an inkjet recording head of an image forming apparatus according to the invention, a shutter is located directly below the leading end of recording paper in the conveyance direction of the recording paper.
Figure 8B:
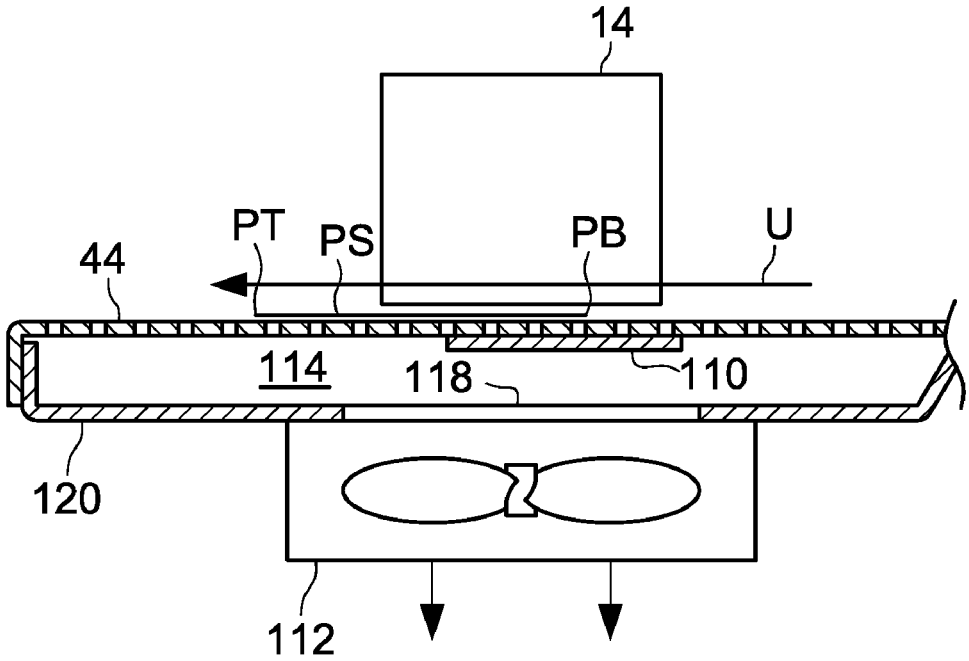
FIG. 8B is a cross-sectional side view showing the state where, directly below an inkjet recording head in the image forming apparatus according to the invention, as shutter is located directly below the tail end of the recording paper in the conveyance direction of the recording paper; and, FIG. 9 is a side view showing the configuration of an image forming apparatus according to the invention.

As shown in FIGS. 8A and 8B, the image forming apparatus of the invention may be provided with a shutter 110 that is reciprocally movable under the conveyance-path forming member 46 along the conveyance direction U, and the distribution of the adhesion force on the conveyance path 44 is changeable according to the position of the moved shutter 110.

The length of the shutter 110 in the conveyance direction is shorter than the length of the sheet-shaped recording paper PS to be conveyed. Further, the positions of the openings 49 provided in the conveyance path 44 are adjusted such that the region to be adhered by negative pressure suction onto the conveyance path 44 is positioned at the inner side of the edges in the widthwise direction of the recording paper PS (the both edges in the direction perpendicular to the conveyance direction U, which are the edges in the direction perpendicular to the paper carrying FIGS. 8A and 8B thereon).

Further, one suction fan 112 is formed in place of three suction fans 52, 54 and 56. Moreover, an air chamber-forming member 120 that forms one air chamber 114 in place of the air chamber-forming member 50 is formed under the conveyance path 44. One opening 118 that allows the suction fan 112 to communicate with the air chamber 114 is formed in the air chamber-forming member 120.

The movement of the shutter 110 in the vicinity of the inkjet recording head 14 is controlled by the control unit 82. The control unit 82 controls the opening and closing of the opening 118 by moving the shutter 110 in synchronization with the passage of the leading end PT of the recording paper P and the passage of the tail end PB of the recording paper P.

When the sheet-shaped recording paper PS as recording paper P is conveyed in such an image forming apparatus, the position of the shutter 110 is controlled as follows: when the leading end PT of the recording paper PS passes directly below the inkjet recording head 14, the position of the shutter 110 is controlled such that the shutter 110 shields directly below a portion at around the leading end PT, as shown in FIG. 8A; when the tail end PB of the recording paper PS passes directly below the inkjet recording head 14, the position of the shutter 110 is controlled such that the shutter 110 shields directly below a portion at or around the tail end PB, as shown in FIG. 8B.

Thus, negative pressure suction can be performed while surely avoiding air turbulence directly below the inkjet recording head 14 at a portion that is at or around the leading end PT of the recording paper PS and a portion that is at or around the tail end PB of the recording paper PS. This is particularly effective when an image is formed on a region that extends to the leading end periphery of the recording paper PS (for example, when a borderless photo-print image is formed). Further, the number of suction fans to be mounted can be reduced thereby.

In the case where the banner recording paper PR1 or PR2 as recording paper P is conveyed and an image is formed thereon, when the leading end PT of the recording paper PR1 or PR2 passes directly below the inkjet recording head 14, the position of the shutter 110 may be controlled such that the shutter 110 shields directly below the leading end PT and a portion around the leading end PT.

Figure 9:
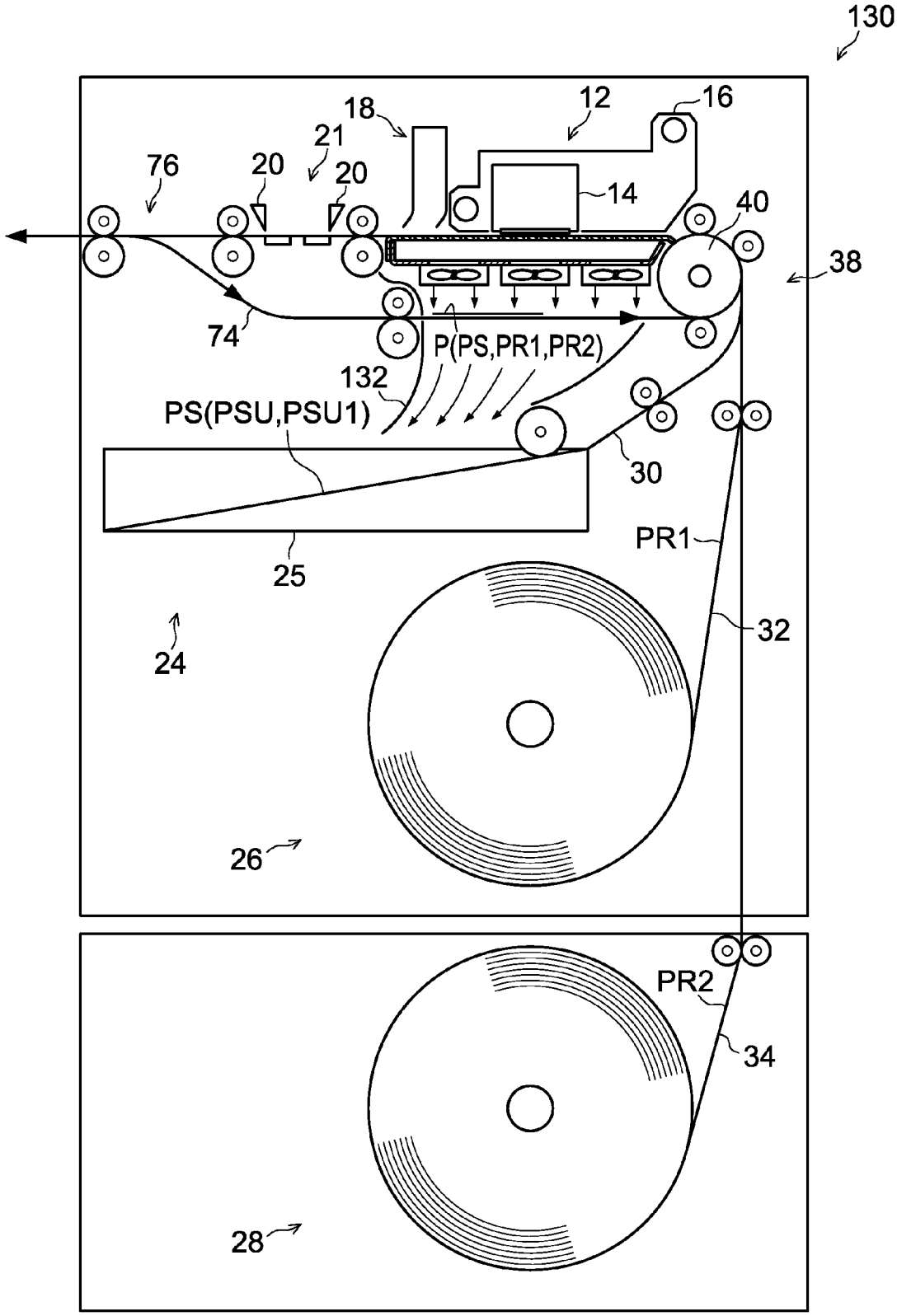

In the image forming apparatus of the invention, a duct 132 may be disposed such that warm air blown from the dryer 18 toward the recording paper immediately after discharged from the image forming section 12 is mixed with air discharged from the switchback conveyance path 74, and the mixed air is blown toward the upper surface of sheet-shaped recording paper PS accommodated in the sheet feed cassette 25, as shown in FIG. 9.

In such an image forming apparatus, a sheet of recording paper PSU, which is the uppermost recording sheet among the sheets of recording paper PS accommodated in the sheet feed cassette 25, tends to curl so that the upper surface is curved inwards; This is because the one surface side—the upper surface side—of the sheet of recording paper PSU has a lower moisture content than that of the lower surface side, and has a higher temperature than that of the lower surface side.

Accordingly, when such a sheet of recording paper PSU is fed from the sheet feed cassette 25 to the decurl conveyance section 38, and thereafter is fed from the sub-scanning roller 40 to the suction-conveyance section 42, the above one surface of the recording paper PSU faces the conveyance path, so that the recording paper PSU is sufficiently curled with its concave surface facing the conveyance path 44 when fed.

Although moisture-control effect can be obtained even when the air blown from the dryer 18 has ordinary temperature, significant moisture-control effect can be attained when the temperature of the air is set to about 70° C.

In such an image forming apparatus, one surface of the recording paper PSU in the sheet feed cassette 25 is moisture-controlled using the warm air blown from the dryer 18 toward the recording paper immediately after discharged from the image forming section 12, and the air discharged in the course of negative pressure suction for adhering the recording paper onto the conveyance path 44.

Accordingly, the structure of the moisture-control mechanism can be simplified, and the recording sheet PSU can be effectively moisture-controlled in a shorter period of time, which produces energy-saving effect.

Even if the distribution of the suction forces is not formed, the recording paper PSU can be conveyed while the separation of the leading end of the recording paper PSU from the conveyance path 44 is sufficiently suppressed. Furthermore, even if the effect of the decurl treatment in the decurl conveyance section 38 is not so large, the recording paper PSU can be conveyed on the conveyance path 44 while the recording paper PSU is adhered thereto by suction and the separation of the leading end of the recording paper PSU from the conveyance path 44 is sufficiently suppressed; therefore the freedom in deigning the decurl treatment section 38 increased significantly.

By setting the temperature of the air blown from the dryer 18 to about 70° C., the drying of the recording paper is promoted during the conveyance in the switchback conveyance path 74; further, since the temperature of the recording paper is raised, sufficient decurling effect by the decurl conveyance section 38 can be obtained.

When one surface of the recording paper PSU is curved inwards sufficiently by such moisture-control, a mechanism that simply feeds the recording paper PSU to the conveyance path 44 without performing decurl treatment may be provided instead of the decurl conveyance section 38, whereby the apparatus can be downsized.

In the image forming apparatus described above, the warm air blown from the dryer 18 toward the recording paper immediately after discharged from the image forming section 12 is mixed with the air discharged from the switchback conveyance path 74, and the mixed air is blown toward the upper surface of the recording paper PSU accommodated in the sheet feed cassette 25. However, the warm air blown from the dryer 18 may alternatively be blown directly to the upper surface of the recording paper PSU accommodated in the sheet feed cassette 25, as a result of which the temperature of the upper surface side of the sheet-shaped recording paper PSU in the sheet feed cassette 25 is further raised, and drying is further promoted, so that the recording sheet has an increased tendency to deform in a shape in which the upper surface is curved inwards (the concave surface faces the switchback conveyance path 74).

Next, a method of performing the image forming method of the invention by using the above-described image forming apparatus is explained. The recording paper PS is fed from the sheet feed cassette 25 to the decurl conveyance section 38, and thereafter, is intermittently fed from the sub-scanning roller 40 to the suction-conveyance section 42. The recording paper PS fed to the suction-conveyance section 42 has undergone some extent of decurl treatment in the decurl conveyance section 38, and thus the curled recording paper PS, with its slightly concavely curved surface facing the conveyance path 44, is fed onto the conveyance path 44.

Figure 3:
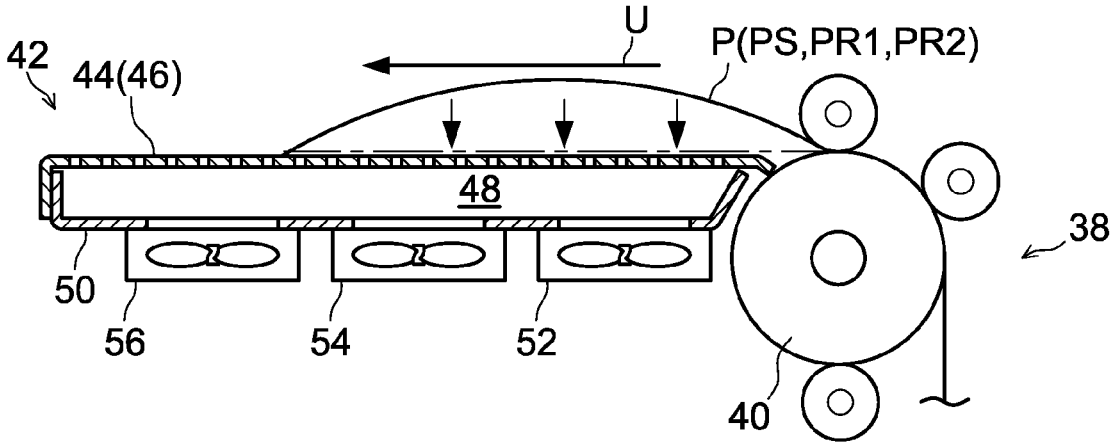
FIG. 3 is a cross-sectional side view explaining that recording paper is conveyed without partially detaching from a conveyance path in an image forming apparatus according to the invention.

The recording paper PS is conveyed while the recording paper PS, starting from the leading end PT, is adhered and held by suction onto the conveyance path 44 due to the strong suction force generated by the suction fan 52. As shown in FIG. 3, when the suction force is not applied to the recording paper P (PS, PR1 or PR2), the recording paper is slightly curled such that a surface thereof facing the conveyance path 44 is curved inwards. Therefore, when suction force is applied to the recording paper PS, the recording paper PS takes a flat form, which conforms to the shape of the conveyance path, and is conveyed. Accordingly, the leading end PT of the recording paper PS does not separate from the conveyance path 44, unlike the case where the recording paper is curled with its convexly curved surface facing the conveyance path 44. That is, in the case where the recording paper is curled such that a surface thereof facing the conveyance path 44 is curved outwards, assuming that the recording paper as a beam, the length of the beam becomes shorter as the distance between the leading end of the recording paper and the point at which a leading end portion of the recording paper starts to separate from the conveyance path 44 becomes shorter, resulting in an increase in the suction force required for adhering the leading end of the recording paper by suction to the conveyance path. Such a phenomenon is avoided when the image forming apparatus of the present invention is used.

In the invention, the tail end of the recording paper PS does not separate from the conveyance path 44 by virtue of curl having a specific orientation. Furthermore, the separation of the leading end PT and the tail end from the conveyance path 44 can be avoided owing to such curl even when the suction force generated by the suction fan 54 is weak in a region directly below the inkjet recording head 14.

The recording paper PS is conveyed on the conveyance path 44 in this way, and an image is formed on the upper surface of the recording paper PS with ink droplets ejected from the inkjet recording head 14 in the image forming section 12. The solvent contained in the ejected ink droplets is absorbed into the coating layer of the recording paper PS and/or paper fibers of the recording paper PS, whereby the upper surface side of the recording paper PS is more elongated than the lower surface side of the recording paper PS due to the liquid absorption. Accordingly, a force that causes the upper surface of the recording paper PS to further curl convexly acts on the recording paper PS.

Further, warm air from the dryer 18 is applied onto the recording paper PS, and the recording paper PS passes through the cutter conveyance section 21 and the branch section 76 in sequence. Then, (i) in the case of image formation on one surface only, the recording paper PS is discharged from the pair of conveyance rollers 72A and 72B;

(ii) in the case of image formation on both surfaces, the conveyance direction is switched to the reverse direction and the recording paper PS is conveyed on the switchback conveyance path 74. The air discharged from the suction fans 52, 54 and 56 is applied onto the upper surface of the recording paper PS during being conveyed on the switchback conveyance path 74. Here, the air temperature inside the apparatus has been raised due to the operation of the dryer 18 of the image forming apparatus 10 and the like, and the humidity inside the apparatus is relatively lowered as compared with the outside atmosphere. Accordingly, at the upper surface side of the recording paper PS, the moisture content is decreased, and additionally, the temperature is raised.

Furthermore, the recording paper PS is conveyed from the switchback conveyance path 74 to the decurl conveyance section 38, at which the recording paper PS is subjected to a decurl treatment. Thus, the recording paper PS that passed the switchback conveyance path 74, at which the moisture content of the upper surface side of the recording paper PS was decreased and the temperature of the upper surface side of the recording paper PS was raised, and the decurl conveyance section 38, at which the recording paper PS was further subjected to the decurl treatment, has a reversed curl direction. That is, the recording paper PS is curled with its upper surface curved outwards, (namely, a surface of the recording paper PS that faces the conveyance path 44 is curved inwards) after discharged from the decurl treatment section 38. Accordingly, when the recording paper PS is conveyed on the conveyance path 44 in the second image formation cycle (image formation on the rear surface), the recording paper PS has a shape that conforms to the conveyance path shape during the conveyance, similar to the first image formation cycle. As a result, the recording paper PS does not experience separation of its leading end from the conveyance path 44, which may occur when the leading end portion of the recording paper is curled with its convex surface facing the conveyance path 44.

An image is formed on the upper surface of the recording medium PS with ink droplets ejected from the inkjet recording head 14 while the recording paper PS is conveyed on the conveyance path 44 in the above-described manner. Thereafter, the recording paper PS is dried by warm air from the dryer 18, and is conveyed through the cutter conveyance section 21, the pair of conveyance rollers 70A and 70B, the branch section 76 and the pair of conveyance rollers 72A and 72B in sequence, and is discharged.

As described in the above, in the image forming apparatus of the invention, the recording paper PS is conveyed in a form that conforms to the shape of the conveyance path no matter whether image formation is performed on one surface or performed on both surfaces using the switchback conveyance path 74; further, the leading end of the recording paper PS does not separate from the conveyance path 44, unlike the case where the leading end portion of the recording paper is curled with its convex surface facing the conveyance path 44.

Further, the suction fan 54, which performs suction with the weakest suction force of the three suction funs 52, 54 and 56, is located directly below the inkjet recording head 14. Accordingly, the generation of strong air flow under the inkjet recording head 14, which air flow inhibits spotting of ink droplets at target positions, can be prevented. This is particularly effective when an image is formed on a region that extends to the leading end periphery of the recording paper PS (for example, when a borderless photo-print image is formed).

Since the recording paper PR1 fed from the first roll paper feed unit 26 and the recording paper PR2 fed from the second roll paper feed unit 28 are each wound in a roll before paper feeding, the recording paper has an already-determined curl direction when the recording paper is unrolled. Namely, the recording paper PR1 or PR2 fed to the conveyance path 44 is already curled such that a surface thereof facing the conveyance path 44 is curved inwards. Accordingly, each of the recording papers PR1 and PR2 can be conveyed on the conveyance path 44 as smoothly as, or more smoothly than, the case where images are formed on both surfaces of the sheet-shaped recording paper PS fed from the sheet feed unit 24; thus, excellent images can be formed on both surfaces of the recording paper.

In the image forming apparatus described above, the air discharged from the suction fans 52, 54 and 56 is applied onto the upper surface of the recording paper P during conveyance along the switchback conveyance path 74, so that the moisture content at the upper surface side of the recording paper P is decreased and the temperature of the upper surface side of the recording paper P is raised. However, warm air blown from the dryer 18 toward the recording paper P immediately after discharged from the image forming section 12 may be introduced into the air discharged from the suction fans 52, 54 and 56. The temperature of the upper surface side of the recording paper P that is conveyed in the switchback conveyance path 74 is further raised thereby, and the drying of the upper surface side is further promoted, so that the recording paper P conveyed in the switchback conveyance path 74 has an increased tendency to deform in a shape in which the upper surface is curved inwards, and the recording paper P after passing through the decurl conveyance section 38 has an increased tendency to curl with its concave surface facing the conveyance path 44 in the suction-conveyance section 42. Accordingly, the capacity of the decurl treatment in the decurl conveyance section 38 needs not be very high, and, furthermore, the decurl conveyance section 38 may be replaced by a mechanism that simply feeds the recording paper P to the conveyance path 44 without performing decurl treatment.

Hereinafter, exemplifying aspects and embodiments of the invention will be described.

<1> An image forming method comprising:

moisture-controlling one surface of an inkjet recording medium having an air permeability of 300 seconds or more;

feeding the moisture-controlled inkjet recording medium onto a conveyance path in a state where the moisture-controlled inkjet recording medium is curled such that a surface of the moisture-controlled inkjet recording medium that is curved inwards faces the conveyance path for conveying the inkjet recording medium;

conveying the fed inkjet recording medium while adhering the inkjet recording medium by suction onto the conveyance path; and forming an image by applying ink by an inkjet method on the inkjet recording medium adhered by suction to the conveyance path.

<2> The image forming method according to <1>, wherein the inkjet recording medium comprises a resin-coated support and an ink receiving layer provided on the support.

<3> The image forming method according to <1>, wherein the inkjet recording medium comprises a resin-coated support having first and second surfaces, a first ink receiving layer provided on the first surface of the support, and a second ink receiving layer provided on the second surface of the support.

<4> The image forming method according to <1>, further comprising:

drying the image-formed surface of the inkjet recording medium by blowing air to the surface on which the image is formed in the image forming, wherein, the moisture-controlling comprises blowing the air that is used for the drying onto one surface of the inkjet recording medium.

<5> The image forming method according to <1>, wherein the suction conveying comprises:

negative pressure suctioning the inkjet recoding medium such that the inkjet recording medium is adhered to the conveyance path; and wherein, the moisture-controlling comprises blowing the air that is discharged from the negative pressure suctioning onto one surface of the inkjet recording medium.

<6> The image forming method according to <5>, further comprising:

drying the image-formed surface of the inkjet recording medium by blowing air to the surface on which the image is formed in the image forming, wherein, the moisture-controlling comprises blowing the air that is used in the drying and the air that is discharged from the negative pressure suctioning onto one surface of the inkjet recording medium.

<7> The image forming method according to <1>, wherein the inkjet recording medium has an air permeability of 1,000 seconds or more.

<8> The image forming method according to <6>, wherein the air that is used in the drying and the air that is discharged from the negative pressure suctioning each comprises a blown air having a relative humidity of from 1% RH to 70% RH.

<9> The image forming method according to <6>, wherein the air that is used in the drying and the air that is discharged from the negative pressure suctioning each comprises a blown air which is from 20° C. to 80° C.

<10> The image forming method according to <6>, wherein the air that is used in the drying and the air that is discharged from the negative pressure suctioning each comprises a blown air having a flow rate of from 0.1 m/s to 10 m/s.

<11> An image forming method comprising:

moisture-controlling a first surface of a first inkjet recording sheet having the first surface and a second surface and having an air permeability of 300 seconds or more;

feeding the moisture-controlled first inkjet recording sheet onto a conveyance path in a state where the moisture-controlled first inkjet recording sheet is curled such that the first surface of the moisture-controlled first inkjet recording sheet is curved inwards and faces the conveyance path;

conveying the fed first inkjet recording sheet while adhering the first inkjet recording sheet by suction onto the conveyance path; and forming an image by applying ink by an inkjet method on the second surface of the first inkjet recording sheet adhered by suction to the conveyance path.

<12> The image forming method according to <11>, wherein the first inkjet recording sheet comprises a resin-coated support and an ink receiving layer provided on the support.

<13> The image forming method according to <11>, wherein the first inkjet recording sheet comprises a resin-coated support having first and second surfaces, a first ink receiving layer provided on the first surface of the support, and a second ink receiving layer provided on the second surface of the support.

<14> The image forming method according to <11>, further comprising:

drying the second surface of the first inkjet recording sheet on which the image is formed in the image forming, by blowing air to the second surface of the first inkjet recording sheet, wherein, a second inkjet recording sheet is moisture-controlled by blowing the air that is used for the drying onto one surface of the second inkjet recording sheet.

<15> The image forming method according to <11>, wherein the suction conveying comprises:

negative pressure suctioning the first inkjet recording sheet such that the first inkjet recording sheet is adhered to the conveyance path; and wherein, a second inkjet recording sheet is moisture-controlled by blowing the air that is discharged from the negative pressure suctioning, onto one surface of the second inkjet recording sheet.

<16> The image forming method according to <15>, further comprising:

drying the second surface of the first inkjet recording sheet on which the image is formed in the image forming, by blowing air to the second surface of the first inkjet recording sheet, wherein, a second inkjet recording sheet is moisture-controlled by blowing the air that is used in the drying and the air that is discharged from the negative pressure suctioning, onto one surface of the second inkjet recording sheet.

EXAMPLES

In what follows, the invention will be described with reference to examples. However, the invention is not restricted to the examples. In the examples below, "part" and "%" mean "parts by mass" and "% by mass", respectively, unless mentioned otherwise.

Example 1

Manufacture of Inkjet Recording Medium

<Manufacture of Resin-coated Support>

LBKP (50 parts) formed from acacia and 50 parts of LBKP formed from aspen were respectively beaten to a Canadian freeness of 300 ml in a disk refiner to form a pulp slurry. Subsequently, to the pulp slurry thus obtained, the following ingredients were added: 1.3% of a cationic starch (CATO 304L (trade name) manufactured by Nippon NSC Ltd.), 0.15% of anionic polyacrylamide (POLYACRON ST-13 (trade name) manufactured by Seiko PMC Corporation), 0.29% of alkyl ketenedimer (SIZEPINE K (trade name) manufactured by Arakawa Chemical Industries, Ltd.), 0.29% by mass of epoxidized behenamide, and 0.32% of polyamide polyamine epichlorohydrin (ARAFIX 100 (trade name) manufactured by Arakawa Chemical Industries, Ltd.), wherein the above percentages are values relative to the amount of the pulp. Thereafter, 0.12% of a defoaming agent was added thereto.

The pulp slurry obtained above was made into paper with a Fourdrinier paper machine, and in the drying process, the felt surface of the web was pressed against a drum dryer cylinder via a dryer canvas, and dried at a dryer canvas tension set to 1.6 kg/cm. Thereafter, both surfaces thereof were coated with polyvinyl alcohol (KL-118 (trade name) manufactured by Kuraray Co., Ltd.) in an amount of 1 g/m$^2$ by size pressing, and were dried and calender-processed. Thus, base paper (substrate paper) with a thickness of 157 μm was obtained, the base paper having a basis weight of 157 g/m$^2$.

After one surface of the obtained substrate paper was subjected to a corona discharge treatment, a polyethylene having a density of 0.93 g/m$^3$ and containing 10% by mass of titanium oxide was extrusion-coated on the one surface of the substrate paper at 320° C. using a melt extruder, to give a coating amount of 24 g/m$^2$.

Subsequently, the opposite surface of the substrate paper was also subjected to a corona discharge treatment, and was extrusion-coated with a polyethylene having a density of 0.93 g/m$^3$ and containing 10% by mass of titanium oxide at 320° C. by use of a melt extruder, to give a coating amount of 24 g/m$^2$.

Thus, polyethylene-resin-coated paper (resin-coated support) in which both surfaces of the base paper were coated with the polyethylene were obtained.

<Preparation of Coating Liquid for Forming Ink Receiving Layer>

After (1) vapor-phase-process silica fine particles, (2) ion exchange water, (3) SHALLOL DC-902P and (4) ZA-30, which are shown in the composition below, were mixed, and dispersed using a liquid-liquid collision type dispersing machine (ULTIMIZER (trade name) manufactured by Sugino Machine Limited), the resultant dispersion was heated at 45° C. and maintained for 20 hours. Thereafter, (5) boric acid, (6) a polyvinyl alcohol solution and (7) cation-modified polyurethane were added to the dispersion at 30° C., whereby a coating liquid for a receiving layer was prepared.

The mass ratio of the silica fine particles and a water-soluble resin (PB ratio=(1):(6)) was 4.9:1, and the pH value of the coating liquid was 3.4, which indicates that the coating liquid was acidic.

| Composition of Coating Liquid for Forming Ink Receiving Layer | |
|---|---|
| (1) Vapor-phase-process silica fine particles (inorganic particles) ((AEROSIL300SF75: trade name) manufactured by Nippon Aerosil Co., Ltd.) | 8.9 parts |
| (2) Ion exchange water | 47.3 parts |
| (3) SHALLOL DC-902P (trade name) (51.5% aqueous solution) (dispersing agent; nitrogen-containing organic cationic polymer; manufactured by Dai-Ichi Kogyo Seiyaku Co., Ltd.) | 0.78 part |
| (4) ZA-30 ((trade name); zirconyl acetate manufactured by Daiich Kigenso Kagaku Kogyo Co., Ltd.) | 0.48 part |
| (5) Boric acid (7.5% aqueous solution) | 4.38 parts |
| (6) Polyvinyl alcohol (water-soluble resin) solution | 26.0 parts |

-continued

| Composition of Coating Liquid for Forming Ink Receiving Layer | |
|---|---|
| (7) Cation-modified polyurethane (SUPERFLEX650-5 (trade name) (25% solution) manufactured by Dai-Ichi Kogyo Seiyaku Co., Ltd.) | 1.8 parts |

| Composition of Polyvinyl Alcohol Solution | |
|---|---|
| JM33 ((trade name; Polyvinyl alcohol; saponification degree 95.5%; polymerization degree 3,300; manufactured by Nippon Sakubi-Poval K. K.) | 1.81 parts |
| HPC-SSL ((trade name) (water-soluble cellulose) manufactured by Nippon Soda Co., Ltd.) | 0.08 part |
| Ion exchange water | 22.96 parts |
| Diethyleneglycol monobutylether (BUTYCENOL 20P (trade name) manufactured by Kyowa Hakko Chemical Co., Ltd.) | 0.55 part |
| Polyoxyethylene lauryl ether (surfactant) (EMULGEN 109P (trade name); manufactured by Kao Corporation) | 0.6 part |

<Formation of Ink Receiving Layer>

After one surface (first surface) of the resin coated support obtained in the above was subjected to a corona discharge treatment, a coating layer was formed on the first surface by coating the coating liquid for forming an ink receiving layer using an extrusion die coater in the following manner:

Specifically, the coating liquid for an ink receiving layer was inline-mixed with the following inline liquid, and the mixed liquid was coated on the support. The supply rates of the respective liquids for the inline mixing are such that the coating amount of the coating liquid for an ink receiving layer would be 150 g/m$^2$ and the coating amount of the inline liquid would be 10 g/m$^2$.

| Composition of Inline Liquid | |
|---|---|
| (1) ALFINE 83 ((trade name) manufacture by Daimei Chemicals Co., Ltd.) | 2.0 parts |
| (2) Ion exchange water | 7.8 parts |
| (3) HYMAX SC-507 ((trade name) Dimethylamine•epichlorohydrin polycondensate; manufactured by Hymo Co., Ltd.) | 0.2 part |

The coating layer formed by the above coating was dried with a hot air dryer at 80° C. (air flow rate of 3 m/second to 8 m/second) until the solid content of the coating layer became 36%. The coating layer showed a constant drying rate during this period. Immediately after this period, the coating layer was immersed for 3 seconds into the liquid that contains a basic compound and that has the following composition to adhere the liquid in an amount of 13 g/m$^2$ to the coating layer, and was further dried at 72° C. for 10 minutes (drying process), as a result of which an ink receiving layer was formed on the first surface of the resin-coated support. The DEG (diethylene glycol) absorption capacity of this ink receiving layer was 18 ml/m$^2$.

| Composition of Basic Compound-containing Liquid | |
|---|---|
| (1) Boric acid | 0.65 part |
| (2) Ammonium carbonate (First grade: manufactured by Kanto Chemical Co., Ltd.) | 5.0 parts |
| (3) Ion exchange water | 88.35 parts |

-continued

| Composition of Basic Compound-containing Liquid | |
|---|---|
| (4) Polyoxyethylene lauryl ether (surfactant) (EMULGEN 109P (trade name) (10% aqueous solution) manufactured by Kao Corporation (HLB value: 13.6)) | 6.0 parts |

Subsequently, the other surface (second surface) of the resin-coated support was subjected to a corona discharge treatment, and an ink receiving layer was formed on the second surface in the same manner as the formation of an ink receiving layer on the first surface.

As described above, an inkjet recording medium having ink receiving layers on both surfaces of the resin-coated support was obtained (the thickness of the ink receiving layer (on each surface) was 29 μm).

The air permeability of the inkjet recording medium thus obtained was measured according to J. TAPPI No. 5B, using an Oken type air permeability and smoothness tester (EYO type: manufactured by Asahi Seiko Co., Ltd.), and the air permeability was found to be 3,000 seconds or more (3,000 seconds being the upper confidence limit of the tester).

<<Image Formation >>

Image formation was performed on the inkjet recording medium obtained in the above under the conditions of 25° C. and 60% RH using an inkjet forming apparatus shown in FIG. 9, and the following evaluations were performed. The ink for the image formation was the ink for FRONTIER DRY MINILAB DL410 ((trade name) manufactured by Fujifilm Corporation).

<Evaluation>

—Failures in Conveyance—

An entire-surface solid black image was printed on ten sheets of the inkjet recording medium obtained above (double-sided image receiving paper in A4 size), the sheets being intermittently fed and conveyed at a conveyance speed of 1,000 mm/second (maximum speed). The conveyance characteristics were evaluated based on the number of sheets that succeeded in image printing on both surfaces thereof and that could be discharged onto the discharge tray, in accordance with the following evaluation criteria. As a result, all the sheets were successfully discharged (ranked at A);

—Evaluation Criteria—

A: all sheets can be discharged;

B: the number of sheets that cannot be discharged is one;

C: the number of sheets that cannot be discharged is two; and

C: the number of sheets that cannot be discharged is three or more.

Comparative Example 1

Image formation was performed in a manner similar to Example 1, except that the dryer 18 was not provided in the inkjet forming apparatus shown FIG. 9.

As a result, no sheets were discharged, and the evaluation result was D. Further, when the inkjet recording medium in the sub-scanning roller part was inspected, the medium was found to be curled such that its convex surface faces the conveyance path.

Comparative Example 2

Image formation was performed in a manner similar to Example 1, except that double-sided glossy paper having an air permeability of 15 seconds ((SP-101D) trade name; manufactured by Canon Inc.) was used in place of the inkjet recording medium used in Example 1.

As a result, the number of sheets that were not discharged was three or more, and the evaluation result was D. Further, when the inkjet recording medium in the sub-scanning roller part was inspected, although the medium was found to be curled with its concave surface facing the conveyance path, conveyance failures on the conveyance path were observed.

From the above results, it is understood that occurrence of failures in conveyance of an inkjet recording medium and deterioration of image quality can be suppressed, and the speed of image printing can be increased, according to the image forming method of the invention.

All publications, patent applications, and technical standards mentioned in this specification are herein incorporated by reference to the same extent as if each individual publication, patent application, or technical standard was specifically and individually indicated to be incorporated by reference.

What is claimed is:

1. An image forming method comprising:

moisture-controlling one surface of an inkjet recording medium having an air permeability of 300 seconds or more;

feeding the moisture-controlled inkjet recording medium onto a conveyance path in a state where the moisture-controlled inkjet recording medium is curled such that a surface of the moisture-controlled inkjet recording medium that is curved inwards faces the conveyance path for conveying the inkjet recording medium;

conveying the fed inkjet recording medium while adhering the inkjet recording medium by suction onto the conveyance path; and forming an image by applying ink by an inkjet method on the inkjet recording medium adhered by suction to the conveyance path.

2. The image forming method according to claim 1, wherein the inkjet recording medium comprises a resin-coated support and an ink receiving layer provided on the support.

3. The image forming method according to claim 1, wherein the inkjet recording medium comprises a resin-coated support having first and second surfaces, a first ink receiving layer provided on the first surface of the support, and a second ink receiving layer provided on the second surface of the support.

4. The image forming method according to claim 1, further comprising:

drying the image-formed surface of the inkjet recording medium by blowing air to the surface on which the image is formed in the image forming, wherein, the moisture-controlling comprises blowing the air that is used for the drying onto one surface of the inkjet recording medium.

5. The image forming method according to claim 1, wherein the suction conveying comprises:

negative pressure suctioning the inkjet recoding medium such that the inkjet recording medium is adhered to the conveyance path; and wherein, the moisture-controlling comprises blowing the air that is discharged from the negative pressure suctioning onto one surface of the inkjet recording medium.

6. The image forming method according to claim 5, further comprising:

drying the image-formed surface of the inkjet recording medium by blowing air to the surface on which the image is formed in the image forming, wherein, the moisture-controlling comprises blowing the air that is used in the drying and the air that is discharged from the negative pressure suctioning onto one surface of the inkjet recording medium.

7. The image forming method according to claim 1, wherein the inkjet recording medium has an air permeability of 1,000 seconds or more.

8. The image forming method according to claim 6, wherein the air that is used in the drying and the air that is discharged from the negative pressure suctioning each comprises a blown air having a relative humidity of from 1% RH to 70% RH.

9. The image forming method according to claim 6, wherein the air that is used in the drying and the air that is discharged from the negative pressure suctioning each comprises a blown air which is from 20° C. to 80° C.

10. The image forming method according to claim 6, wherein the air that is used in the drying and the air that is discharged from the negative pressure suctioning each comprises a blown air having a flow rate of from 0.1 m/s to 10 m/s.

11. An image forming method comprising:

moisture-controlling a first surface of a first inkjet recording sheet having the first surface and a second surface and having an air permeability of 300 seconds or more;

feeding the moisture-controlled first inkjet recording sheet onto a conveyance path in a state where the moisture-controlled first inkjet recording sheet is curled such that the first surface of the moisture-controlled first inkjet recording sheet is curved inwards and faces the conveyance path;

conveying the fed first inkjet recording sheet while adhering the first inkjet recording sheet by suction onto the conveyance path; and forming an image by applying ink by an inkjet method on the second surface of the first inkjet recording sheet adhered by suction to the conveyance path.

12. The image forming method according to claim 11, wherein the first inkjet recording sheet comprises a resin-coated support and an ink receiving layer provided on the support.

13. The image forming method according to claim 11, wherein the first inkjet recording sheet comprises a resin-coated support having first and second surfaces, a first ink receiving layer provided on the first surface of the support, and a second ink receiving layer provided on the second surface of the support.

14. The image forming method according to claim 11, further comprising:

drying the second surface of the first inkjet recording sheet on which the image is formed in the image forming, by blowing air to the second surface of the first inkjet recording sheet, wherein, a second inkjet recording sheet is moisture-controlled by blowing the air that is used for the drying onto one surface of the second inkjet recording sheet.

15. The image forming method according to claim 11, wherein the suction conveying comprises:

negative pressure suctioning the first inkjet recording sheet such that the first inkjet recording sheet is adhered to the conveyance path; and wherein, a second inkjet recording sheet is moisture-controlled by blowing the air that is discharged from the negative pressure suctioning, onto one surface of the second inkjet recording sheet.

16. The image forming method according to claim 15, further comprising:

drying the second surface of the first inkjet recording sheet on which the image is formed in the image forming, by blowing air to the second surface of the first inkjet recording sheet, wherein, a second inkjet recording sheet is moisture-controlled by blowing the air that is used in the drying and the air that is discharged from the negative pressure suctioning, onto one surface of the second inkjet recording sheet.

* * * * *